US005215228A

United States Patent [19]

Andrews et al.

[11] Patent Number: 5,215,228

[45] Date of Patent: Jun. 1, 1993

[54] VOLUMETRIC DRY MATERIAL FEEDER

[75] Inventors: Robert L. Andrews; Edward A. Packard, both of Plymouth, Mass.

[73] Assignee: Hyer Industries, Inc., Pembroke, Mass.

[21] Appl. No.: 681,051

[22] Filed: Apr. 5, 1991

[51] Int. Cl.[5] ..... A45D 24/22

[52] U.S. Cl. ..... 222/203; 222/234; 406/134

[58] Field of Search ..... 222/198, 200, 202, 203, 222/234; 406/134, 76

[56] References Cited

U.S. PATENT DOCUMENTS

| | | | |
|---|---|---|---|
| 1,570,795 | 1/1926 | Tainton | 222/202 X |
| 2,381,802 | 8/1945 | Booth et al. | 222/203 X |
| 2,646,905 | 7/1953 | Vincent | 222/200 |
| 2,732,099 | 1/1956 | Davis | 222/203 X |
| 3,363,806 | 1/1968 | Blakeslee et al. | 222/202 X |
| 4,810,156 | 3/1989 | Pendelton et al. | 222/203 X |

FOREIGN PATENT DOCUMENTS

| | | | |
|---|---|---|---|
| 2250432 | 4/1974 | Fed. Rep. of Germany | 406/134 |

OTHER PUBLICATIONS

Kocher, James M., "Dry Material Feeding Handbook," 1986, pp. 1-34.

Brochure, "ACCU-RATE Model 612 Sanitary Dry Chemical Feeders," 1981, 4 pp.

Brochure, "TECWEIGH Reliaflo Feeder Model C-14," Tecnetics Industries Inc., 1989, 2 pp.

Brochure, "OMEGA Volumeteric Dry Material Feeder, Series 25," The Merrick Corporation, 1989, 8 pp.

*Primary Examiner*—Gregory L. Huson

*Attorney, Agent, or Firm*—Lahive & Cockfield

[57] ABSTRACT

A volumetric dry material feeder comprising a movable wall hopper. Nesting lower and end wall hopper components receive and clamp a flexible diaphragm sheet in position to overlie mutually opposing hopper walls and to receive and isolate the material therefrom. A pair of thrust plates are each located between the diaphragm and a hopper wall and alternately displaced relative thereto at differing frequencies to produce a continually varying combination of thrust plate movements.

9 Claims, 3 Drawing Sheets

VOLUMETRIC DRY MATERIAL FEEDER

BACKGROUND OF THE INVENTION

This invention relates generally to feeders for pulverulent dry materials such as fine powders, as well as for flakes, granules, chips, pellets and pebbles that are difficult to feed from hoppers at continuous, controllable volumetric rates. The spectrum of such materials includes, for example, ceramics, cosmetics, plastics, foods and pharmaceuticals.

Problems frequently encountered in producing uniform, controllable volumetric feed rates of such particulate materials include erratic metering of the flow, exposure of the plant environment to the material, flooding of the material, surging or pulsating discharge from the feeder, erratic feeding of denser followed by lighter material, and compaction or clogging of the material in the hopper. It is desirable to promote and maintain, without the use of excessive manual labor, a constant, uniform flow of the material from the hopper, without producing material degradation or compaction.

To overcome these problems, various systems have been employed. These have included a variety of means such as massaging paddles or plates to flex the hopper walls, and other means to create pulsating, vibrating, undulating, flexing, agitating or otherwise activated movement of the hopper walls or of panels within or adjacent the hopper walls. Still other devices have employed multiple auger and agitator means such as a large auger and a small or metering auger. Various other forms of internal stirring devices have also been employed.

The volumetric dry material feeders in prior use have been developed for applications such as proportioning materials in processing operations, continuous mixes and bag loading applications, for example. A common problem in these applications arises when such materials are delivered from a hopper to a feeder, which may be a screw or auger feeder, a belt feeder or the like. The material within the hopper tends to discharge erratically because of the formation of bridging or stable arch formations, rat holes, tunnels or funnels which may form and intermittently collapse. The material is also subject to compaction and clogging which may interrupt or completely stop the flow. As a result, it is difficult to obtain accurate volumetric metering of the material and a precisely controllable feed rate.

A principal object of this invention is to provide an improved dry material feeder that permits the attainment of a constant and accurately adjustable volumetric feed rate. A related object is to provide means for readily adjusting the operation of the feeder to maintain proper flow conditions by observation of the material and adjustment as it is flowing, and thereby to maintain the desired flow rate.

Another object is to provide a feeder adapted for feeding a wide range of materials including those that are extremely difficult to feed at a constant rate due to the persistence of the above-mentioned flow interrupting phenomena.

Still further objects are to provide a feeder having a hopper construction of reduced cost with a minimum exposure of fasteners or other devices to the material within the hopper, and to provide for the replacement in less expensive form of parts that come in contact with the material.

Another object is to provide a feeder that presents minimum hazards to worker safety in operation, with minimal danger of discharge of dry material powders or particulates into the surrounding environment.

With the above and other objects in view, as hereinafter appearing, the features of this invention include a movable wall hopper forming mutually opposing sloping wall portions, each having a thrust plate supported adjacent thereto and movable alternately between positions mutually displaced relative to the wall portion. The thrust plates are located to displace the material in opposing directions by reciprocating movement, thereby displacing the material within the hopper. The thrust plates are each provided with driving means adapted to reciprocate the plates at different cycle frequencies and independently of the discharge auger speed, whereby the material in the hopper is displaced relative to the walls by a continually varying combination of the opposing thrust plate movements.

The hopper comprises lower and upper components that are adapted to nest together with a flexible diaphragm sheet clamped between them and overlying the mutually opposing sloping wall portions to form flexible wall panels The lower component comprises the opposing, sloping wall portions, and the upper component comprises the end panels of the hopper when in the nested position.

The flexible diaphragm is displaced by the thrust plates which are sandwiched between the diaphragm and the lower hopper wall portions. Means for actuating the thrust plates are mounted externally of the hopper in positions where their operation may be readily adjusted. Means for adjustment comprise timers for independently varying the cycle frequencies of alternate movements of the thrust plates, means for varying the rate at which the thrust plates displace the material, and means for varying the amplitudes of such movements while observing the effect upon the continuing flow of material from the hopper.

Other features of the invention will become evident from the following description with reference to the appended drawings.

FIG. an exemplary diagram schematically representing the alternating, opposing movements of the thrust plates relative to the hopper walls as functions of time.

DETAILED DESCRIPTION

Figure 1:
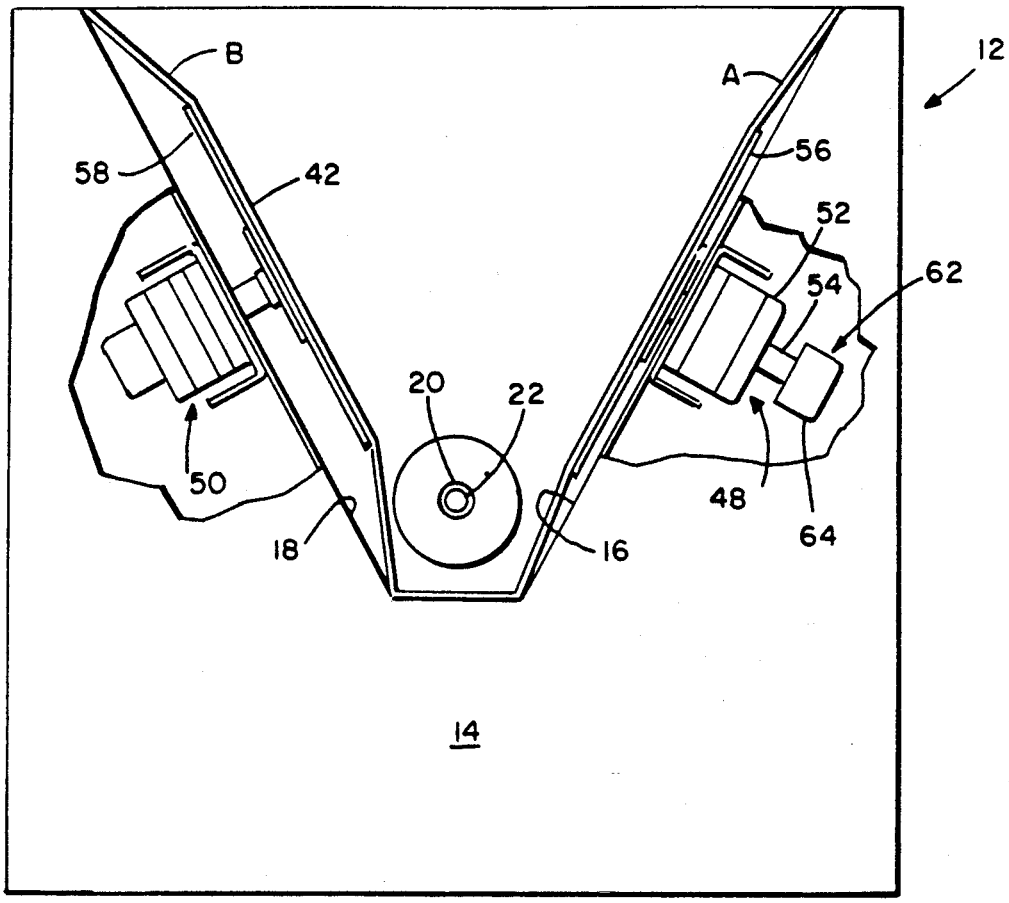
FIG. 1 is an elevation of a feeder embodying the invention.
Figure 2:
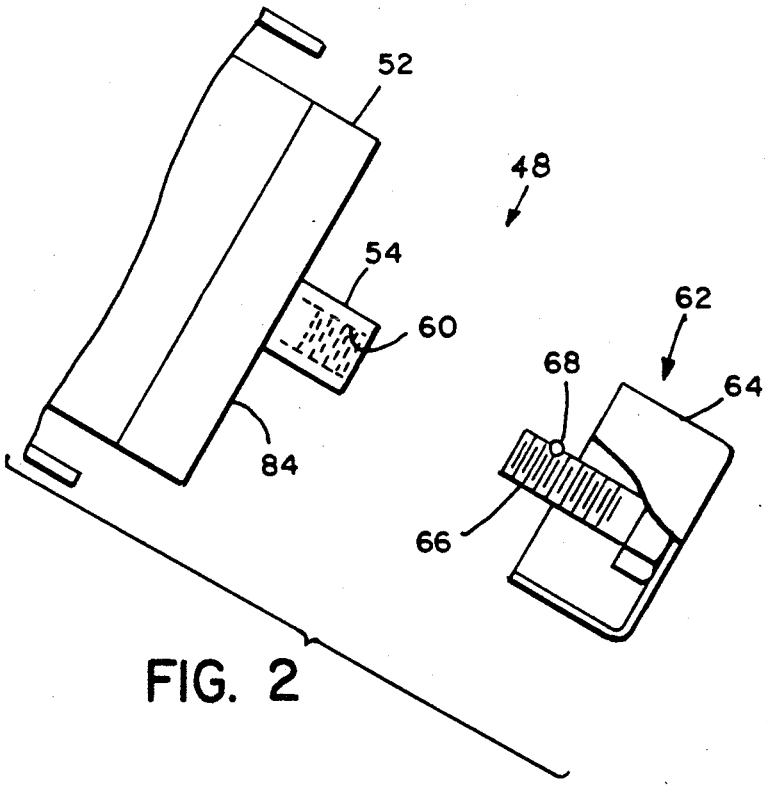
FIG. 2 is an enlarged fragmentary view of a portion of FIG. 1 showing the mechanical thrust amplitude or stroke adjustment controls.
Figure 3:
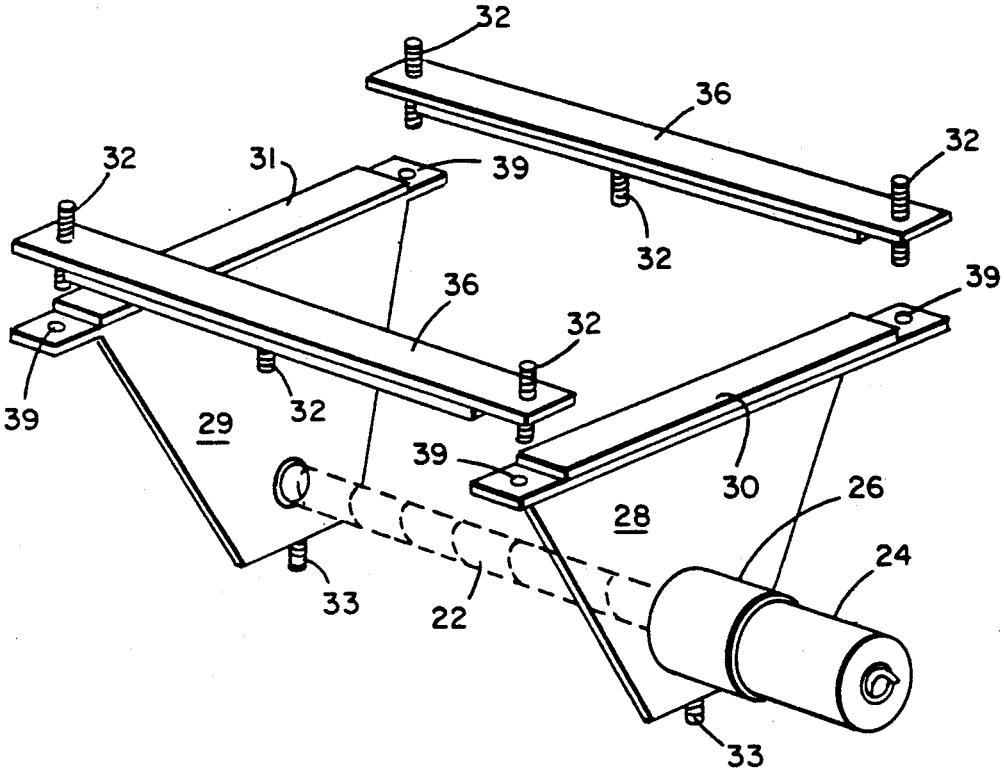
FIG. 3 is an exploded view of the hopper.
Figure 3:
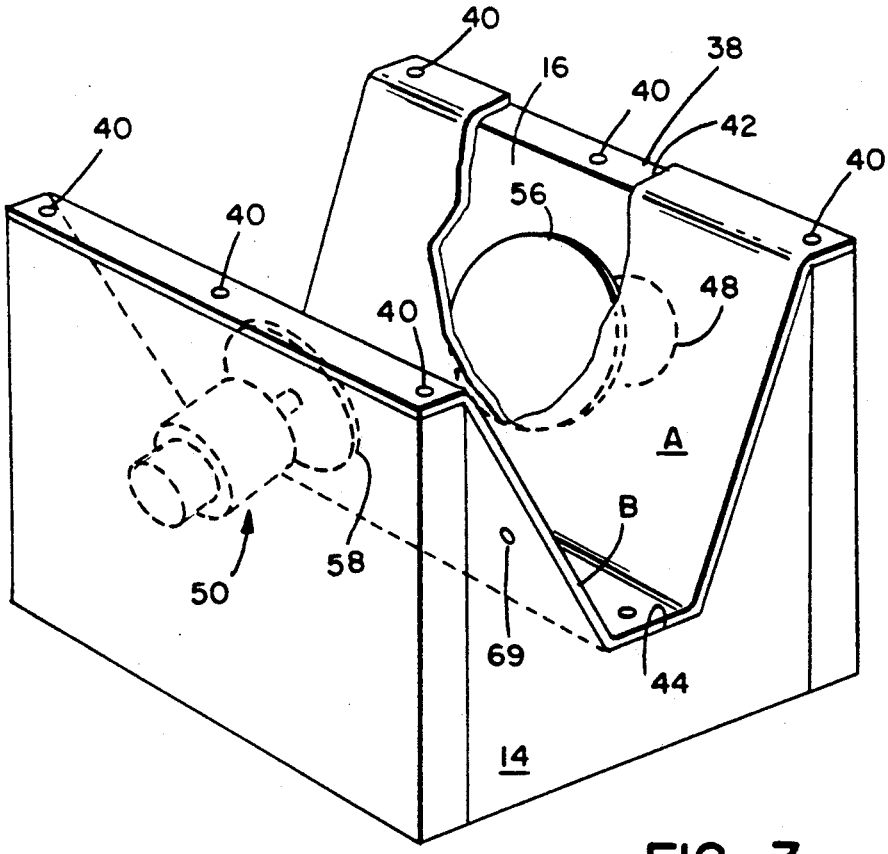

Referring to FIGS. 1–3, the feeder of this invention generally designated 12 preferably comprises a lower hopper component 14 comprising a welded steel box frame having a pair of flat, mutually opposing, downwardly sloping wall portions 16 and 18 forming a truncated "V" trough hopper and terminating at an elongated discharge opening 20. In this embodiment the opening 20 comprises the flights of a stainless steel screw or auger feeder 22 of helical shape extending the length of the trough formed between the walls 16 and 18. The auger is supported within a tube 24 insertable into a support sleeve 26 fastened on an end panel 28 that extends between the walls 16 and 18. A second end panel 29 also extends between the walls 16 and 18 to complete the closure of the hopper walls. The end panels 28 and 29 have outwardly directed flanges 30 and 31, and are secured to the lower hopper component 14 by stud bolts 32 and 33. The stud bolts 32 are welded into holes in flange members 36 which overlie horizontal surfaces 38 on the component 14, and four of the stud bolts pass through holes 39 in the flanges 30 and 31, into holes 40 in the surfaces 38. The stud bolts 33 project from the bottoms of the end panels and into the bottom of the trough in the component 14.

The auger 22 is driven by conventional means (not shown) which preferably comprise a D.C. motor with a potentiometer variable speed control.

A hopper liner or diaphragm 42 comprises a sheet or panel of neoprene or other suitable elastomeric material. The diaphragm overlies the sloping hopper wall portions 16 and 18, a surface 44 forming the hopper trough and the surfaces 38. The stud bolts 32 securely clamp the diaphragm between the flange members 36 and the surfaces 38. The stud bolts 32 and 33 also clamp the diaphragm between the lateral and bottom edges of the end panels 28 and 29 and the surfaces of the walls 16 and 18 and the trough surface 44. Thus the diaphragm forms a pair of mutually opposing flexible hopper wall panels A and B.

The fully assembled hopper is sealed on all sides except at the top, and may be easily secured beneath additional hopper or bin sections or extensions by means of the stud bolts 32 or other fasteners. The upper and lower hopper components may be quickly separated when necessary to replace a worn, ripped or torn diaphragm 42. The diaphragm material may be conveniently supplied in roll form in any of a variety of different compositions. Since the diaphragm projects between the upper and lower hopper components it is not necessary to cut it to a precise size. The assembly is arranged to eliminate the need for fasteners exposed to the material in the hopper, and to reduce the size and number of parts exposed to the material in the hopper.

Apparatus is provided to activate the side panels or walls A and B formed by the diaphragm within the hopper, as hereinafter described. Thrust drivers 48 and 50 are located at each of the walls 16 and 18 of the hopper. These are of identical construction and therefore only the driver 48 is described in detail.

A pneumatic cylinder 52 is mounted to the exterior of the hopper wall 16 by any suitable means. A cylinder rod 54 extends through an aperture in the wall 16 and is secured at its end to a circular thrust plate 56 bearing upon the hopper panel A formed by the diaphragm 42. The driver 50 has an identical thrust plate 58 bearing upon the opposing hopper panel B formed by the diaphragm.

The cylinder rod 54 projects from the opposite end of the cylinder 52 and its end is formed with an axial, threaded blind bore 60. A stroke or thrust amplitude adjuster 62 comprises a metallic cup-shaped collar 64 welded to a threaded machine screw 66, which is adjustably threaded into the bore 60. A locking insert 68 on the screw 66 provides sufficient friction to prevent the thrust adjuster from turning in the threads of the cylinder rod 54 except when deliberately turned by manual rotation of the collar 64.

Since the movements of the thrust plates expand and contract the spaces between the diaphragm and the hopper wall portions 16 and 18, the latter are provided with small apertures such as 69 (FIG. 3) to permit the movement of air.

From the foregoing description it will be apparent that the thrust plates 56 and 58 are independently actuated by separate pneumatic means. Also, since the cylinder rods are actuated by pneumatic means, such actuation is entirely independent of the driving means for the auger 22. The latter means have been omitted from the drawing and may take any conventional form preferably provided with speed controls to vary the volumetric rate of material delivery from the discharge tube 24. This feature provides a wider turndown capability because it is possible to activate the thrust plates at a high energy level, thereby breaking arches in the material in the hopper, at very low auger speeds.

Figure 4:
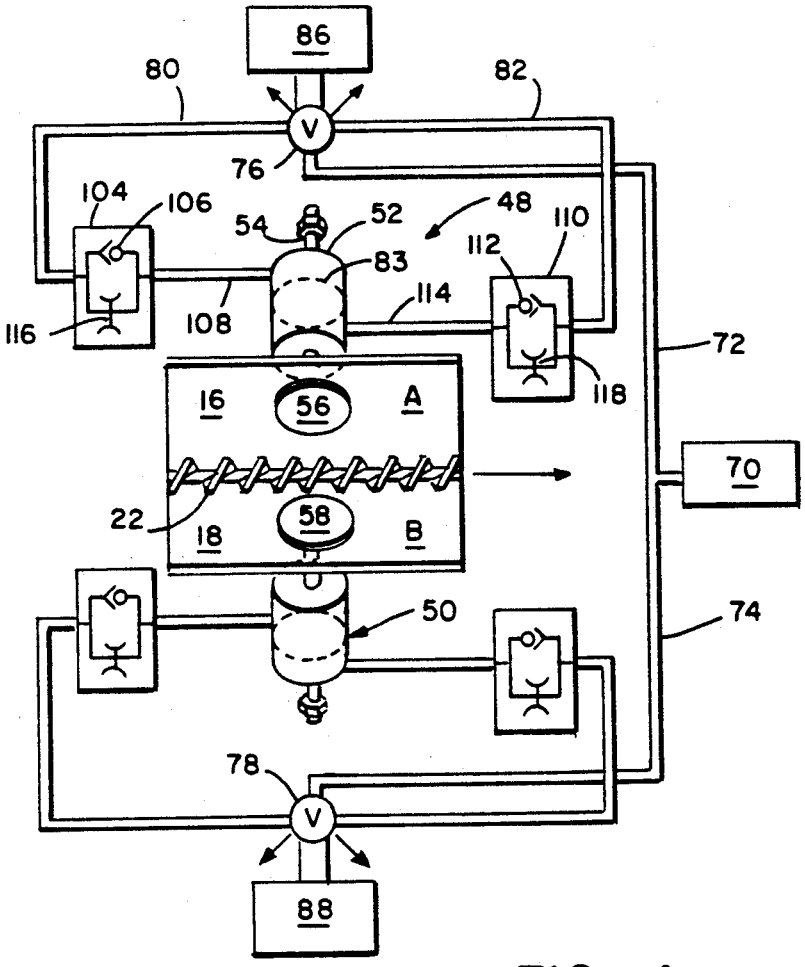
FIG. 4 a schematic diagram illustrating the pneumatic driving controls for the thrust plates.

FIG. 4 schematically illustrates the apparatus for actuating the pneumatic thrust drivers 48 and 50. A conventional air source 70 is connected with pressure lines 72 and 74 respectively connected to control valves 76 and 78. The apparatus associated with the valve 76 will be described in further detail, the apparatus associated with the valve 78 being of identical construction.

The valve 76 is a solenoid actuated, spring return pneumatic valve adapted, when the solenoid is energized, to connect the pressure line 72 with a line 80 for extending the cylinder rod 54 in a direction to extend the thrust plate 56 toward the interior of the hopper. When the solenoid is deenergized the valve 76 returns by spring action to connect the pressure line 72 with a line 82 to retract the thrust plate in the reverse direction. The amplitudes of these movements or strokes may be, for example, one inch on a hopper wall measuring 15 by 20 inches.

Suitable adjustable mechanical limits may be provided for the motions of each thrust plate, in addition to the limits determined by the impingement of the piston 83 on the internal ends of the cylinder 52. The inward or extension motion is limited by the impingement of the adjustable collar 64 on an end surface 84 of the cylinder 52 (FIG. 2). The latter movement is conveniently adjusted either while the thrust drivers 48 and 50 are at rest or while they are being cyclically operated as hereinafter further described.

The solenoid of the valve 76 is energized in a cyclical manner by an electronic timer 86. The solenoid of the valve 78 is independently energized by a separate, identical timer 88. The timers 86 and 88 may be constructed to allow the operator of the apparatus to select and set the time interval between the energization and deenergization of the solenoid valves. However, it has been found adequate for many applications simply to set this interval at the factory and to make it identical for both of the valves.

On the other hand, the time intervals between successive energizations of the valves 76 and 78, that is their cycle frequencies, is variable by the operator, preferably by means of calibrated controls for each of the timers 86 and 88 mounted on one side of the lower hopper component 14. In a practical embodiment, the cycle frequency of each timer is adjustable between three and twenty seconds, with a constant interval of 1½ seconds of energization of each solenoid valve in each cycle.

Thus the timers 86 and 88 each actuate a corresponding pneumatic cylinder to extend its thrust plate from a first position nearer to or adjacent to a hopper wall 16 or 18 to a second position displaced inwardly of the hopper wall. In the above described simplified embodiment, the thrust plate remains in the second, extended position for a fixed, factory set dwell time interval and is then retracted to the first position for a dwell time interval that is variable by the machine operator.

Figure 5:
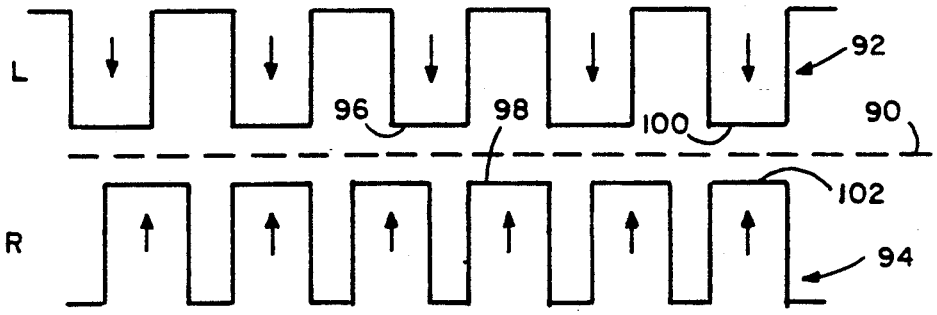

The operator controls the timers 86 and 88 so that the frequencies of the cycles of movement of the respective thrust plates are different as illustrated in FIG. 5. FIG. 5 schematically illustrates the axis 90 of the feed auger, and lines 92 and 94 schematically illustrate the movements of the thrust plates 56 and 58 respectively, as functions of time represented by the direction from left to right. Each thrust plate movement produces a corresponding shift in the material within the hopper. At certain times, as represented by dwell times 96 and 98, the movements of the thrust plates occur sequentially, shifting the material first in one direction and then in the opposite direction relative to a vertical plane through the axis 90. At other times, as represented by dwell times 100 and 102, the thrust plates move from their first positions to their second positions simultaneously, reducing the hopper volume symmetrically with respect to that vertical plane. At still other times the thrust plate movements have a varying overlapping relationship with respect to time depending on the respective cycle frequencies, whereby a continually varying combination of opposing thrust plate movements results.

In practice, the machine operator observes the flow of material from the feed auger, and adjusts the frequencies of the respective timers 86 and 88 as necessary to produce satisfactory flow.

The connections from the valves 76 and 78 to their respective pneumatic cylinders include flow control valves such as 104 of the type commonly used in connection with pneumatic drive cylinders. When pressure is applied to the line 80, air passes through a one-way path 106 to a line 108, and is applied to the cylinder 52 to extend the thrust plate 56 from its retracted position to its extended position. The line 82 subsequently applies pressure to a similar valve 110, and a similar one-way path 112 applies pressure to a line 114 to move the thrust plate 56 from its extended position to its retracted position. In this latter movement the air previously supplied by the line 108 to the cylinder 52 flows through an adjustable bleed outlet 116 and the line 80 to the valve 76 where it is exhausted to atmosphere. The valve 110 has a corresponding adjustable bleed outlet 118. By appropriate adjustment of the bleed outlets 116 and 118, the speed of the movements between the retracted and extended positions of the thrust plate 56, and between the extended and retracted positions, may be independently controlled. Thus, if a bleed outlet is throttled the movement of the cylinder rod is slowed down. By adjustment this may limit the amplitude of the extension or retraction movement. Adjustments of the bleed outlets 116 and 118 can be controlled while the timers 86 and 88 are respectively operating to produce repetitive movements of the thrust plates, and it is not necessary to interrupt the operation of the apparatus for such adjustment purposes.

Although the above described embodiment of the invention employs pneumatic cylinders as the drivers for the thrust plates, other equivalent means such as electrically actuated solenoids may be employed, and the movements of the solenoid plungers may be adjustably controlled by suitable mechanical stops, damping springs, dash pots or friction devices.

In the event that the diaphragm 42 should rupture or tear, the material within the hopper is confined by the wall portions 16 and 18.

We claim:

1. A volumetric dry material feeder comprising, in combination, a hopper having a pair of mutually opposing wall portions converging downwardly toward a discharge opening, a pair of thrust plates each supported adjacent and generally parallel to one of said wall portions and between said wall portions, the thrust plates being mutually opposed, and a pair of thrust drivers each external to the hopper and having a member extending through one of said wall portions and attached to the adjacent thrust plate, each thrust driver being energizable to translate a thrust plate reciprocally in a direction normal to its adjacent wall portion, and actuating means adapted to energize said thrust drivers to reciprocate the respective thrust plates cyclically at differing frequencies.

2. A feeder according to claim 1, including flexible diaphragm means overlying each thrust plate and isolating said material therefrom.

3. A feeder according to claim 2, in which a single diaphragm sheet overlies both of the thrust plates.

4. A feeder according to claim 3, in which the hopper comprises a lower member comprising said pair of wall portions and being open at the lateral ends thereof, and end wall means nestable over said diaphragm sheet and upon said lower member and comprising a pair of end panels interconnecting said pair of wall portions at the lateral ends thereof.

5. A feeder according to claim 1, in which the actuating means is adapted to adjust the amplitude of the reciprocal translation of each thrust plate independently of the other thrust plate.

6. A feeder according to claim 1, including means to vary the speed of translation of the thrust plates.

7. A feeder according to claim 1, in which the actuating means are adapted to reciprocate each thrust driver in cycles, each cycle including first and second time intervals, the first time interval commencing with the movement of the corresponding thrust plate from a first position nearer the adjacent wall portion and ending with the return of the thrust plate to said first position, the thrust plate remaining in said first position during the second time interval, the first time interval being fixed and the second time interval being variable for both thrust drivers.

8. A feeder according to claim 7, in which said fixed time interval is the same for both thrust drivers.

9. A feeder according to claim 7, in which each thrust driver has stop means external to the hopper and adjustable to vary a limit of movement of the corresponding thrust plate.

* * * * *